US005361602A

United States Patent [19]

Furukawa et al.

[11] Patent Number: 5,361,602

[45] Date of Patent: Nov. 8, 1994

[54] COUPLING STRUCTURE FOR STACK-ON TYPE AUTOMATIC ICE MAKING MACHINE

[75] Inventors: Yoshio Furukawa, Toyoake; Kazuhisa Okada, Nagoya, both of Japan

[73] Assignee: Hoshizaki Denki Kabushiki Kaisha, Toyoake, Japan

[21] Appl. No.: 151,519

[22] Filed: Nov. 12, 1993

[30] Foreign Application Priority Data

Nov. 24, 1992 [JP] Japan ..... 4-080844[U]

[51] Int. Cl.[5] ..... F25C 5/18

[52] U.S. Cl. ..... 62/344; 312/111; 430/326

[58] Field of Search ..... 62/344, 298; 403/6, 403/326, 327, 375; 312/111

[56] References Cited

U.S. PATENT DOCUMENTS

| | | | |
|---|---|---|---|
| 2,953,565 | 2/1960 | Klebe | 403/327 X |
| 2,982,586 | 5/1961 | Gliebe | 403/326 X |
| 3,552,579 | 1/1971 | Simon et al. | 312/111 X |
| 3,913,343 | 10/1975 | Rowland et al. | 62/344 X |
| 4,290,710 | 9/1981 | Waller | 312/111 X |
| 4,304,523 | 12/1981 | Corsmeier et al. | 403/326 X |
| 4,722,199 | 2/1988 | Hibino | 62/344 |
| 4,966,008 | 10/1990 | Yoshida et al. | 62/344 X |
| 5,020,336 | 6/1991 | Hida | 62/344 |
| 5,253,480 | 10/1993 | Sakai | 62/298 X |
| 5,291,752 | 3/1994 | Alvarez et al. | 62/344 |

*Primary Examiner*—William E. Tapolcai
*Attorney, Agent, or Firm*—Brooks Haidt Haffner & Delahunty

[57] ABSTRACT

A stack-on type automatic ice making machine includes an ice making unit having a box-like casing housing an ice making mechanism, and a stocker within which a space opening upwardly is defined and on which the ice making unit is disposed. A coupling structure for connecting together the ice making unit and the stocker includes a plurality of ribs formed integrally with an external wall of the stocker along a top edge thereof, and a plurality of coupling plates secured fixedly to an external wall of the casing of the ice making unit and each having a hole for receiving each of the ribs and a resilient tongue adapted to engage in a recess formed in a bottom of each rib. The ribs are imparted with strength sufficiently high for withstanding shearing and bending loads. The ice making unit connected to the stocker through the coupling plates fitted on the ribs is positively prevented from displacement relative to the stocker. The resilient tongues of the coupling plates engage in the grooves formed in the bottoms of the ribs suppress resiliently relative movement between the ice making unit and the stocker.

3 Claims, 2 Drawing Sheets

COUPLING STRUCTURE FOR STACK-ON TYPE AUTOMATIC ICE MAKING MACHINE

BACKGROUND OF THE INVENTION

1. Field of the Invention

The present invention generally relates to an automatic ice making machine and, more particularly, to a coupling structure for connecting together an ice making unit and an ice storage or stocker in a stack-on type automatic ice making machine.

2. Description of the Prior Art

There is known such an ice making machine which is adapted to continuously manufacture ice blocks such as prismatic ice pellets by making use of an ice making mechanism. In that case, the amount of the ice as manufactured does not generally coincide with that of water consumed for making the ice. Under the circumstances, a stocker is used in combination with the ice making machine for storing the ice pellets as manufactured until they are used. In this regard, although the ice making mechanism is intrinsically imparted with a self-cooling function, the stocker lacks such cooling capability. According, the stocker has to be implemented in a heat insulating structure for preventing heat conduction from the exterior. For this reason, the ice making unit and the stocker are initially manufactured as separate components and finally assembled together by stacking the ice making mechanism on the stocker or vice versa. The ice making machine of this structure is referred to as the stack-on type ice making machine.

Heretofore, the stocker is constituted by using inner and outer boxes each made of a sheet metal or alternatively an inner box made of a resin and an outer box of a sheet metal, wherein a hollow space defined between both the boxes is filled with a heat insulating material in either case. For rigidly interconnecting the stocker with an ice making unit accommodating therein an ice making mechanism, nuts or the like clamping parts are used and secured by welding to the metal sheet casing of the ice making unit and the outer box of the stocker, wherein the ice making unit and the stocker are fixedly connected together by means of coupling plates.

When the outer box is made of a sheet metal, attachment of the nuts by welding or the like means as well as formation of threaded holes can be carried out relatively simply and easily while ensuring dimensional tolerance and mechanical strength as required, whereby the interconnection or coupling of both units can be realized satisfactorily.

However, when the inner and outer boxes of the stocker are formed integral with each other in an effort to reduce the manufacturing cost, difficulty is encountered in attaching the nuts or the like clamping parts and formation of the threaded holes when considering the molding die to be used to this end and the strength of the resin material.

Thus, there exists a demand for an coupling structure for connecting together the stocker and the ice making unit disposed thereon without need for forming threaded holes or attaching nuts to the stocker while ensuring a sufficient mechanical strength.

SUMMARY OF THE INVENTION

The present invention is directed to a stack-on type automatic ice making machine which includes an ice making unit having a box-like casing accommodating therein an ice making mechanism and a stocker within which a space opening upwardly is defined and on which the ice making unit is disposed. According to an aspect of the invention, there is provided a coupling structure for connecting together the ice making unit and the stocker with high rigidity, which structure comprises a plurality of ribs formed integrally with an external wall surface of the stocker along a top edge portion thereof and extending outwardly, and a number of coupling plates secured fixedly to an external wall of the box-like casing of the ice making unit, wherein each of the coupling plates has a hole for receiving each of the ribs and a resilient tongue adapted to engage in a retaining recess formed in a bottom of each rib.

The ribs are imparted with a strength sufficiently high for withstanding shearing and bending loads. The ice making unit connected to the stocker through the coupling plates snugly fitted onto the ribs is positively prevented from displacement relative to the stocker. The resilient tongues of the coupling plates engage in the recesses or grooves formed in the bottoms of the ribs, respectively, to thereby suppress relative movement between the ice making unit and the stocker. Thus, the present invention provides a coupling structure of a high mechanical strength for interconnecting the ice making unit and the stocker without need for forming any threaded bores or the like in the stocker, because the latter is connected to the ice making unit by means of the coupling plates fitted onto the ribs formed integrally with the stocker.

DESCRIPTION OF THE PREFERRED EMBODIMENTS

Figure 1:
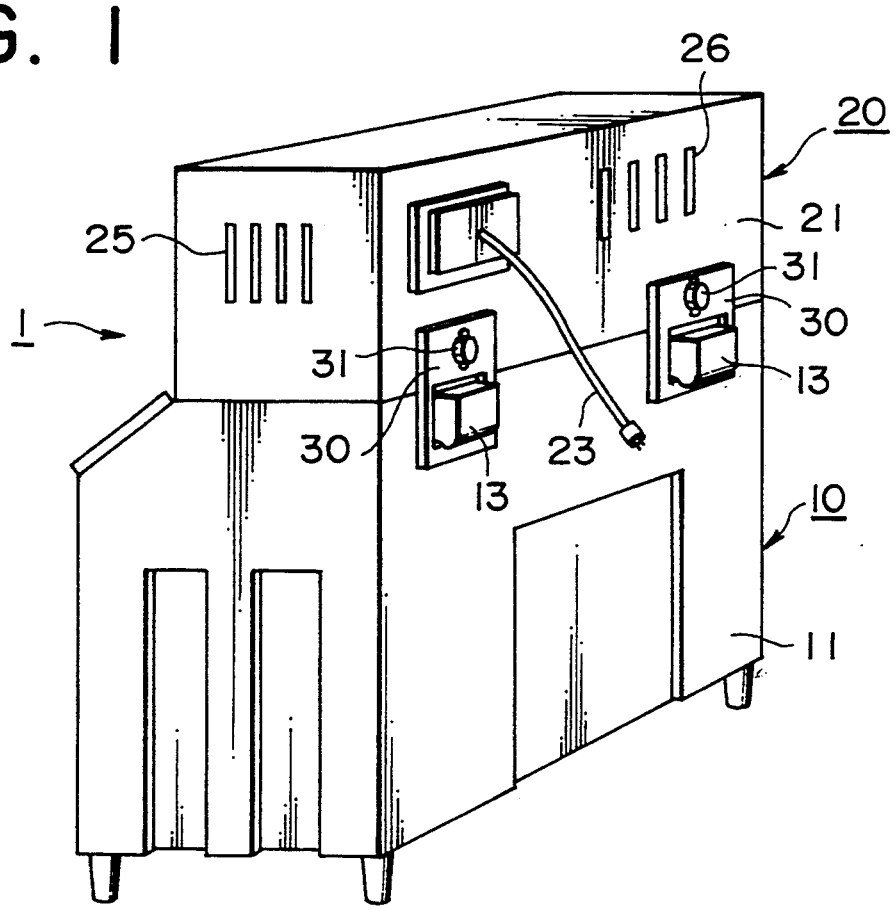
FIG. 1 is a perspective view showing an outer appearance of an stack-on type automatic ice making machine according an embodiment of the invention.

Now, the present invention will be described in detail in conjunction with a preferred embodiment thereof by reference to the accompanying drawings, in which like reference characters designate like or corresponding parts.

FIG. 1 is a perspective view showing an outer appearance of an stack-on type automatic ice making machine 1 according to the preferred embodiment of the invention as viewed obliquely from a rear side of the machine. Referring to the figure, an ice making unit 20 is disposed on a stocker (ice storage box) 10 formed of a resin in an integral structure. Formed integrally with a rear wall 11 of the stocker 10 along a top edge portion thereof are a pair of ribs 13 with an appropriate distance therebetween, which ribs 13 project rearwardly and have retaining grooves formed at the bottoms thereof, respectively.

The ice making unit 20 includes a box-like casing 21 made of a sheet metal within which a refrigerator (not shown) is housed, together with an ice making mechanism utilizing a coolant evaporator of the refrigerator as a cooler. A cable 23 for supplying electric power to the refrigerator and the ice making machine extends outwardly from a rear wall of the casing 21. Further, louvers 25 and 26 are provided in side and rear walls of the casing 21 for the purpose of heat discharge and ventilation.

Figure 2:
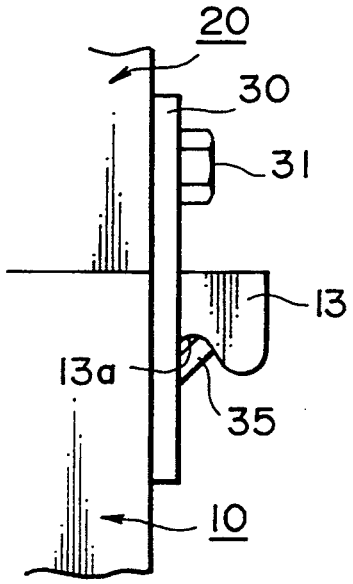
FIG. 2 is a fragmental side view of the ice making machine and shows a coupling structure employed therein.
Figure 3:
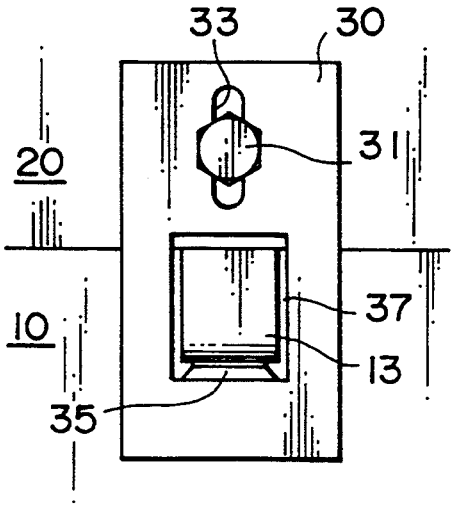
FIG. 3 is a fragmental front view of the same showing the coupling structure.

On the other hand, coupling plates 30 are fixedly secured to the rear wall of the casing 21 of the ice making unit along a bottom edge portion thereof by clamping means such as bolts 31. Although not shown, the tip end portion of the bolt 31 is received screwwise by an appropriate nut such as a blind nut which is secured to the inner wall surface of the casing 21. FIGS. 2 and 3 show in a side view and a front view, respectively, a coupling structure implemented by using the coupling plate 30. As can clearly be seen in FIG. 3, a hole 33 of an elliptic or elongated circular form is formed in a top end portion of the coupling plate 30 for receiving the bolt 31 therethrough. The coupling plate 30 is a single-piece member formed by a punching press and having a rectangular hole 37 formed at a position located below the elliptical hole 33. The hole 37 is provided with a resilient tongue 35. As can be seen from FIG. 2, the hole 37 is adapted to receive snugly therein the rib 13 with the resilient tongue 35 engaging in the retaining recess 13*a* formed in the bottom the rib 13.

Figure 4:
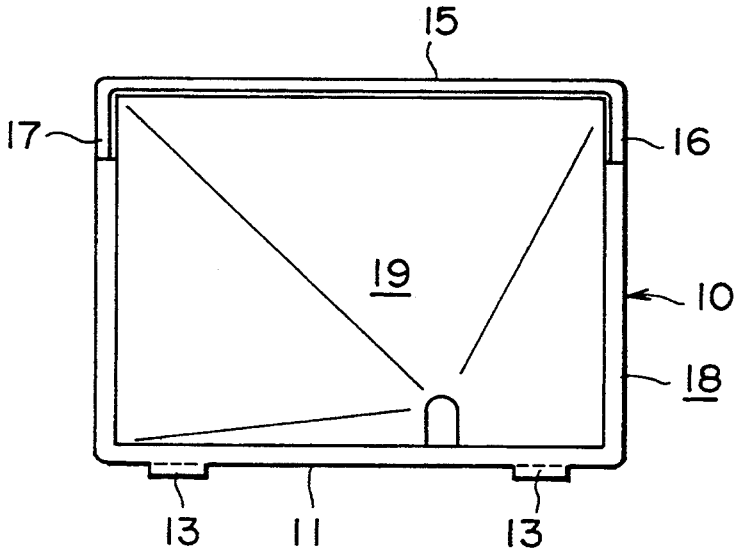
FIG. 4 is a fragmental top plan view of a stocker of the ice making machine.

FIG. 4 is a top plan view of the stocker 10. The stocker is generally of a rectangular box-like configuration with the ribs 13 being formed in the rear wall of the stocker with an appropriate distance therebetween, as mentioned previously. The stocker 10 has a front wall 15 having a top edge of a height slightly lower than that of the rear wall, wherein wall portions 16 and 17 extend obliquely from the top edge of the front wall 15 to a topmost wall 18. An inner space 19 having an inclined bottom is defined within the stocker 10 for storing ice pellets.

As will be appreciated from the above description, in the automatic ice making machine according to the invention, the coupling plates 30 clamped fixedly to the automatic ice making unit are adapted to receive snugly therein the ribs 13 formed integrally with the stocker 10 along the top edge thereof. Further, the resilient tongue 35 is brought into physical contact with the bottom recess 13*a* formed in the rib 13. Thus, the ice making unit 20 disposed at the top of the stocker is coupled and fixedly secured thereto while being protected against the relative movement.

We claim:

1. In a stack-on type automatic ice making machine including an ice making unit having a box-like casing, accommodating therein an ice making mechanism, and an ice stocker having an external wall defining a space with an open top and disposed on said ice making unit, a coupling structure for interconnecting said ice making unit and said stocker to each other, said structure comprising:

a plurality of ribs formed integrally with the external wall of said stocker along a top edge portion thereof and extending outwardly; and a plurality of coupling plates secured fixedly to the external wall of said casing of said ice making unit, said plates each having a first hole for receiving each of said ribs and a resilient tongue adapted to engage in a recess formed in a bottom of each of said ribs.

2. A coupling structure for an ice making machine according to claim 1, wherein an elongated circular hole is formed in each said coupling plate extending longitudinally of said coupling plate, said coupling plate being fixedly clamped to said casing by a bolt inserted through said elongated circular hole.

3. A coupling structure for an ice making machine according to claim 1, wherein said coupling plates each are as a single-piece member by a punching press, said resilient tongue member being formed integrally with a bottom of said first hole.

* * * * *